US006038797A

United States Patent [19]

Smith

[11] Patent Number: 6,038,797

[45] Date of Patent: Mar. 21, 2000

[54] AUTOMATICALLY DEPLOYABLE, INFORMATION-BEARING DISPLAY PANEL

[75] Inventor: Michael J. Smith, Orangeburg, N.Y.

[73] Assignee: Arrow Art Finishers, L.L.C., Princeton, N.J.

[21] Appl. No.: 09/064,275

[22] Filed: Apr. 22, 1998

[51] Int. Cl.[7] ..... G09F 3/00

[52] U.S. Cl. ..... 40/312; 40/610; 40/124.08; 206/768

[58] Field of Search ..... 40/124.06, 124.08, 40/124.09, 124.14, 312, 313, 610, 539; 206/45.28, 45.29, 767, 768; 229/116.1, 922

[56] References Cited

U.S. PATENT DOCUMENTS

| | | | |
|---|---|---|---|
| 527,688 | 10/1894 | Hernsheim | 40/312 |
| 1,524,880 | 2/1925 | Rippenbein . | |
| 1,776,134 | 9/1930 | Scruby et al. . | |
| 2,282,280 | 5/1942 | Yogg | 40/124.15 |
| 2,322,849 | 6/1943 | Horr | 206/45.29 |
| 2,361,562 | 10/1944 | Park | 40/124.15 |
| 2,914,236 | 11/1959 | Shapiro . | |
| 3,351,182 | 11/1967 | Greer et al. | 206/768 X |
| 4,201,291 | 5/1980 | Davidson | 206/768 |
| 4,784,314 | 11/1988 | Penick | 40/312 X |
| 4,828,164 | 5/1989 | Passamoni . | |
| 5,055,084 | 10/1991 | Jokic | 40/539 X |
| 5,467,547 | 11/1995 | Forther | 40/610 |
| 5,813,596 | 9/1998 | Dahlquist | 40/124.08 X |

*Primary Examiner*—Brian K. Green
*Attorney, Agent, or Firm*—Kirschstein, et al.

[57] ABSTRACT

A display arrangement device for displaying information about items being offered to the public includes a generally box-shaped main body, and at least one formation secured to and extending along one of the top, bottom, and side portions of the main body. This formation includes a front wall having a front surface carrying information to be brought to the attention of the observer, and a bracing wall connected to the main body at a back wall and extending therefrom to the front wall to hold the front wall, in a deployed condition of the formation, in substantial parallelism with a vertical plane to present the information to the observer's view. The bracing wall includes two sections and a hinge portion connecting the two sections to one another for folding into juxtaposition with one another in response to the application of external collapsing forces. A shipping container that holds the main body in its entirety has a wall that confines the collapsed formation between itself and the main body. The hinge portion has resilient properties to urge the formation toward and into its deployed position once the holding action of the container is discontinued. The formation may, however, be separate from the main body and connected to, or merely resting on, or suspended from, it.

10 Claims, 2 Drawing Sheets

AUTOMATICALLY DEPLOYABLE, INFORMATION-BEARING DISPLAY PANEL

BACKGROUND OF THE INVENTION

1. Field of the Invention

The present invention relates to display arrangements in general, and more particularly to information-bearing display panels for items to be held on display in a store or another similar establishment.

2. Description of the Related Art

There are already known various constructions of display structures, among them such that are capable of holding various items, be they articles of manufacture such as consumer goods, brochures or other publications, or other objects, in positions relative to a passerby and potential observer that display such items to their best advantage. It has also been proposed before not only to make the display structures as attractive as possible (as distinguished from the rather drab appearance of the traditional corrugated or cardboard boxes or the like), but also to provide such structures with information that would attract the attention of the passerby and make him or her notice the items being promoted, or the identity of their manufacturer, or any other similar information that may be presented on the display structure.

Experience has shown, however, that merely putting this information on the surfaces of the otherwise parallelepiped display structure that are exposed to view (most of the time its side surfaces) does not make this information prominent enough to really attract the attention of the person passing by on his or her way to the location at which the items that person intends to purchase are situated. In view of that, it had been proposed to provide the traditional box-shaped display structures with panels or formations, be they referred to, depending on their locations relative to a main body, as "headers", "footers" or "side bars", each of which forms a frame-like extension of the main body adjacent the opening in which the items are held while on display and hence presenting an additional display surface that can be (and, because that was the idea behind providing such an extension to begin with, is) provided with the aforementioned attention-grabbing information.

In its most primitive form in which the display structure or device is constituted by the ordinary shipping carton (of corrugated board, cardboard or the like) the items came in, one or more of the flaps that had originally closed the region of the box through which the items on display are now accessible may be used to form the respective extension(s). However, it has been established that rarely, if ever, are the attempts to cause such flaps to assume, and particularly remain in or even close to, their desired positions, in which they extend outwardly at right angles to the adjacent carton walls, successful. This is at least in part attributable to the fact that the hinge portion that connects the respective flap with the adjacent carton wall "remembers" that its "original" state (i.e., while the carton was still a closed box) was also at a right angle but in the opposite direction, or at least that the flap's real original state (i.e., as manufactured) was along the same plane as its adjacent carton wall, so that the flap will exhibit a pronounced tendency to revert to its original condition. Hence, the flap moves at least toward the plane of the adjacent wall, if not beyond.

One previously proposed way of dealing with this problem was to embed at least one wire or similar element in a corrugation of the display device, this element passing both through the flap and the adjacent wall while extending substantially perpendicularly across the hinge portion, and to give this element a "memory" of its own, but with a countervailing effect. This is done by making this element of a material (typically a metal alloy) that can be rather easily deformed (owing to human intervention) but, once deformed, remains deformed until intentionally deformed again.

Yet, this solution is rather expensive, not only because such specialty materials are not exactly cheap, but also because of the extra effort involved in inserting these elements into the display devices. Moreover, and possibly more importantly, merely embedding these elements in the display devices does not give any assurance that the flaps or extensions will be properly (or at all) deployed at the final destination. Rather, given the widespread custom of the store personnel to merely cut off the top of a box (such as that containing carbonated beverages) when it is desired to keep the contents confined in the container it came in and yet make it visible to the purchasing public, it is more than likely that the same practice will be followed even with respect to the boxes equipped with such elements, thus defeating the very purpose of inserting them in the first instance and bringing the additional expenditure and effort involved in utilizing this expedient to naught.

As exemplified by U.S. Pat. No. 1,524,880; No. 1,776,134; No. 2,914,236 and No. 4,828,164, the art has disclosed information-bearing display panels or headers that are either integral with, or separate pieces from, display structures. In any case, such headers are required to be manually moved and manipulated into position—a situation which not only adds cost and labor, but also which can be performed poorly, especially by untrained personnel, thereby resulting in a sloppy advertising display.

OBJECTS OF THE INVENTION

Accordingly, it is a general object of the present invention to avoid the disadvantages of the prior art.

More particularly, it is an object of the present invention to devise a display device of the type here under consideration that does not possess the drawbacks of the known devices of this type.

Still another object of the present invention is to provide an extension or formation especially for use with such a display device that remains in its fully deployed condition to display information to be presented to the public to its best advantage.

It is yet another object of the present invention to develop the above formation in such a manner that its deployment from a folded condition into its deployed condition is, at least by and large, automatic.

A still further object of the present invention is to so design the information-bearing extension that it can be rather easily folded into its collapsed condition in which it can be reliably confined between a main portion of the device and a shipping container accommodating such a device.

A concomitant object of the present invention is so to construct the display device and/or formation of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display arrangement for displaying information about items being offered to the public. This display arrangement includes a display structure including a generally box-shaped main body having a top portion, a bottom portion, and two side portions as considered in a position of use of the display structure, as well as a front region facing an observer of the display structure in its use position and a back wall remote from the front region.

At least one formation is secured to and extends along one of the above-mentioned portions of the main body. This formation includes a front wall situated at the front region, anchored to the one portion of the main body at an anchoring zone, and having a front surface carrying information to be brought to the attention of the observer, as well as a bracing wall connected to the main body at the back wall and extending therefrom to a connection zone of the front wall that is spaced from the anchoring zone, and hingedly connected to the connection zone to hold the front wall, in a deployed condition of the formation, in substantial parallelism with a vertical plane as considered in the use position and hence to present the information to the observer's view.

According to the present invention, the bracing wall includes two sections and a hinge portion extending substantially parallel to the connection zone and connecting the two sections to one another for folding into juxtaposition with one another in response to external forces tending to move the front wall and the sections of the bracing wall from the deployed condition to a collapsed or folded condition of the formation. Last but not least, there is also provided means for holding the formation in its collapsed condition prior to the display structure assuming its use position.

According to another aspect of the present invention, the holding means includes a shipping container that accommodates the display structure in its entirety and has a wall that confines the formation in the collapsed condition thereof between itself and the main body. It is particularly advantageous when the hinge portion has resilient properties to urge the formation toward and into its deployed position once the holding action of the holding means is discontinued.

A particular advantage of the display arrangement as described so far is that, because the hinge portion is bent out of its original planar (and coplanar with the neighboring bracing wall sections) shape in one sense only—as opposed to the situation described above where it is bent in one sense to close the box and in the opposite sense to become deployed—its tendency, upon discontinuance of the forces urging it toward or keeping it in its compressed state corresponding to the folded or collapsed relative positions of the bracing wall sections, is to return to its original uncompressed state, taking the bracing wall sections with it toward and into coplanarity. Another way of looking at this is that the material of the hinge portion is in its stressed state when the formation is collapsed, and relaxed when the formation is deployed—the very opposite of the situation arising under the circumstances alluded to before—so that its "natural" tendency is to deploy the formation, rather than collapse it.

Similar reasoning is also applicable to any and all other hinge or folding region(s) or portion(s) that may be present on the formation, albeit with the proviso that because of the generally cross-sectionally triangular configuration of the formation, they cannot ever reach their original coplanar positions unless the formation is totally disassembled. Even so, all of such folds or hinges cooperate to bring about the desired "pop-out" action upon release of the formation from the confinement of the holding means. Whether or not this action results in complete deployment of the formation is not important; even if a little bit of extra push is required from the personnel installing the display arrangement to make the two bracing wall sections coplanar (and hence bracing themselves against each other and thus keeping the front wall in its normal-to-adjacent-wall position), most of the deployment has already taken place and the only result of inaction on the part of such personnel would be that the front wall would deviate to a small extent from its intended final position; the very purpose of providing this formation would not be compromised, though.

In accordance with another facet of the present invention, there is provided a display formation for displaying information that is to be brought to the attention of an observer of the formation. This formation includes a front wall having a front surface carrying the information and including, as considered in a deployed condition of the formation, a proximal anchoring zone and a distal connection zone. Anchoring means is connected to the anchoring zone of the front wall and has a back zone that is spaced backwardly, as considered in the deployed condition, from the anchoring zone.

A bracing wall is connected to the back zone and extends from there to the connection zone of the front wall. The bracing wall is hingedly connected to the connection zone to hold the front wall, in the deployed condition of the formation, in substantial parallelism with a vertical plane and hence to present the information to the observer's view. The bracing wall includes two sections and a hinge portion extending substantially parallel to the connection zone and connecting the two sections to one another for folding into juxtaposition with one another in response to external forces tending to move the front wall and the sections of the bracing wall from the deployed condition to a collapsed condition of the formation.

There is also provided means for holding the formation in its collapsed condition prior to deployment. Here again, the hinge portion advantageously has resilient properties to urge the formation toward and into the deployed position thereof once the holding action of the holding means is discontinued.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
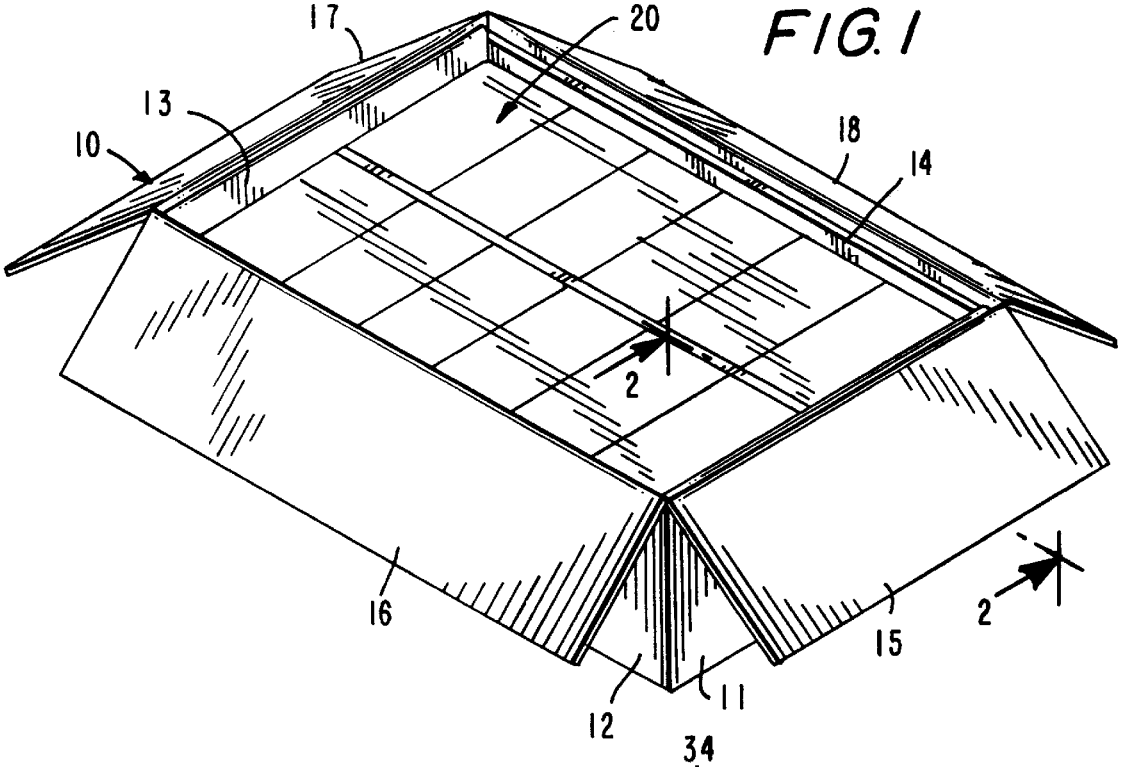
FIG. 1 is a perspective view showing a display arrangement incorporating the present invention while confined in a shipping carton in its shipping condition.

Referring now to the drawing in detail, and first to FIG. 1 thereof, it may be seen that the reference numeral 10 has been used therein to identify a shipping container or carton. There is hardly anything, except possibly its dimensions, to distinguish this carton 10 from other known containers of its ilk; like they, it is preferably made of cardboard, especially its corrugated variety, and consists of a multitude of interconnected walls, such as visible panels or flaps 11 to 19 and possibly other ones that cannot be seen in FIG. 1 or 2, of which only a side panel 11 is worth of singling out in that it has a special function—to be mentioned later—in the context of this invention.

The dimensions of the shipping container 10 are geared toward accommodation, with only a small amount of leeway, of another substantially box-shaped structure 20 within the container 10. The structure 20, on the whole, is also quite conventional in nature, that is it is also advantageously made of cardboard or similar stock, especially of corrugated cardboard, has a generally box-shaped configuration, and is supportive not only in the sense of being self-supporting (meaning that it will not collapse when taken out of the shipping container 10) but also in that of being capable of supporting other items, as it is intended to do in the illustrated embodiment showing the structure 20 in its incarnation as a display device for holding any selected ones of a variety of goods on display in a store or a similar retail or non-retail establishment.

Of course, such goods or items may (but need not) be present in the shipping container 10 while the latter is being used for storing and/or transporting the display structure 20, be it in their intended ultimate display positions or elsewhere. What is important in the context of the present invention is that the display structure 20 is constructed and/or embellished in such a manner as to convey information about such goods, their manufacturer or the like—in short, advertising materials. As such, the display structure 20 need not, in the final analysis, even be used for displaying such goods (or their specimens or verisimilar facsimiles); rather, it can be used as an advertisement device pure and simple for such goods (or even for services); still, the word "device" when referring to the structure 20 will be quite consistently modified herein by the adjective "display" not only because the currently preferred use of the device 20 in its deployed condition is to actually display the goods (or their manufacturer, etc.) being promoted as mentioned before, but also because the device 20 actually displays something—at the very least the aforementioned advertising information.

In that context, it is important to note that one of the main distinguishing features of the present invention is to be found in the manner in which such information is actually displayed, that is in the way at least a part of this information (i.e., the logo of the A.B.C. Corp. in the example illustrated with particularity in FIG. 3 of the drawing) is carried and presented. As shown there, the information is provided on what is commonly referred to in the industry as the "header", i.e., a formation 30 that, in the deployed condition of the display device 20, forms an upward extension of a main body 21 of the device 20. However, the formation 30 or its kin could (also or instead) be used as one or more of a "footer" or "sidebar" extensions of the main body 21.

Figure 3:
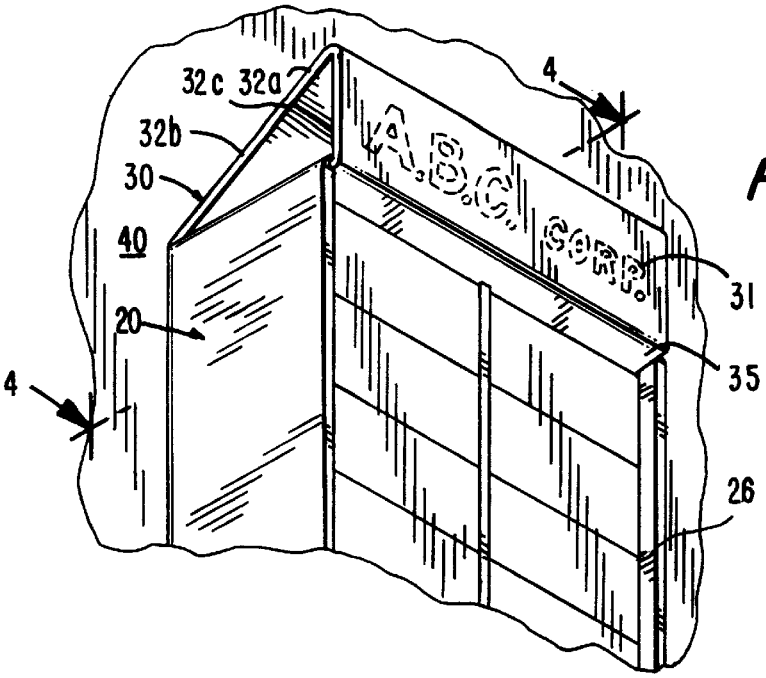
FIG. 3 is a perspective view showing, on a scale approximating that of FIG. 1, an upper portion of the display structure of the present invention in its deployed and mounted condition, as observed from below left.

In any event, for the information on display to be shown to its full advantage, a front wall 31 of the formation 30 that carries such information should, at least ideally, extend substantially normal to an adjacent (in the chosen example a top) wall of the main body 21 in the deployed condition of the display device 20 as shown in FIG. 3. This at least implies that some mechanism should be present to keep the wall 31 in or close to this ideal relative position. On the other hand, in the illustrated embodiment of the invention, the formation 30 is actually an integral part of the display device 20, that is it is of one piece with the main body 21. As such, it accompanies the main body 21 on its way into and out of the shipping container 10. At least under these circumstances, it would be at the very least impractical if not outright damaging to the formation 30 if the wall 31 of the formation 30 were to extend at a right, acute or obtuse angle with respect to a back wall 22 of the main body 21 when the display device 20 is received in or moved into or out of the shipping container 10.

To solve this dilemma, that is to accommodate both of these considerations (and still another one to be mentioned later), it is proposed in accordance with the present invention to provide the formation 30 with another, bracing, wall that is identified in FIG. 4 in its entirety by the reference numeral 32 and is connected to the front wall 31 by a fold region 33, and to make this bracing or supporting wall 32 of two sections designated as 32*a* and 32*b* that are connected to one another by a "weakened" hinge portion 32*c*. What is meant by "weakened" is merely that the hinge portion 32*c* constitutes a preferential bending or folding region for the two sections 32*a* and 32*b* relative to each other; it should not be considered to involve any substantial impairment of the inherent properties of the portion 32*c*. As a matter of fact, the inherent "stiffness" of the material of the hinge portion 32*c* comes to good use in the situation depicted in FIG. 4 of the drawing where it causes the entire supporting wall 32 to extend substantially (i.e., without unacceptable sagging) along the same plane for the wall 32 reliably to maintain the front wall 31 in its deployed or erect position. On the other hand, this weakening of the hinge portion 32*c* makes it possible relatively easily to fold the wall sections 32*a* and 32*b* on top of one another, with the front wall 31 following suit to be eventually situated on top of the wall section 32*a* in the folded or collapsed condition of the formation 30.

Figure 2:
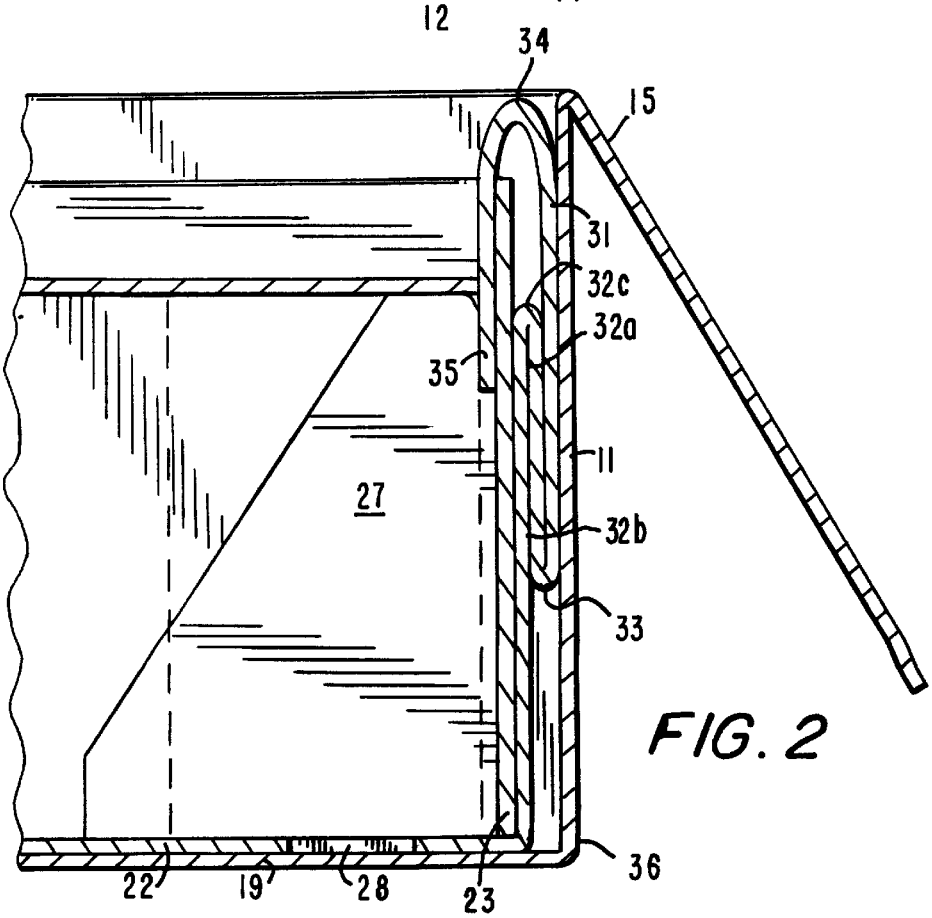
FIG. 2 is a partial sectional view taken on line 2—2, and on a scale enlarged with respect to that, of FIG. 1.

It is in this its collapsed condition that the formation 30 is depicted in FIG. 2 of the drawing. It may be seen there not only that the wall sections 32*b* and 32*a* and the front wall 31, in that order, are folded into at least partial juxtaposition with one another as indicated above, but also that they all fit into the confines of the shipping container 10, that is that their vertical dimensions as considered in FIG. 2 and the locations of the various folding regions such as 32*c* and 33 are such that they weave to and fro merely within the region delimited by the vertical dimension of the wall 11 of the shipping container 10. It may be recalled at this point that it had been stated before that the side panel 11 was worthy of mentioning for a special purpose it serves. The time has come to reveal that that purpose is to hold the formation 30 in its folded or collapsed condition while the display device 20 in its entirety, that is including the formation 30 that constitutes its integral part in this illustrated embodiment of the invention, is confined within the shipping container 10.

On the other hand, once the display device 20 is withdrawn from the confines of the shipping container 10, the formation 30 is released from the confining action of the wall 11 as well. That means that it is free to assume its erected or deployed condition. However, just being free to do something does not in and of itself mean that the formation 30 will actually do so. This is where the other consideration that had been mentioned before but not yet explained enters the picture. More particularly, it is desirable for the deployment to take place automatically, at least for the most part, if not for any other reasons then to facilitate the unfolding for the store or similar personnel engaged in installing the display device 20 and/or to remind such personnel of the need to take the presence of the formation 30 into consideration during the installation in the first place.

To pay heed to this additional criterion, it is proposed in accordance with the present invention to perform the aforementioned weakening of the hinge portion 32*c* (and/or, along a similar vein, of the folding region 33) in such a manner that the material affected thereby retains its "memory", that is exhibits a tendency to return to its original, unfolded state. With respect to at least the hinge portion 32*c*, this may be achieved, as indicated in FIG. 4 of the drawing, by merely compressing its material, typically corrugated board having a thickness on the order of 1/16 of an inch, preferably, as shown, by situating the resulting groove on the side of the wall 32 to which the folding is to take place. That way, the absence of material from what is to become the outside of the fold not only facilitates but also creates the propensity to bend in that direction, especially in response to application of external folding forces to the formation 30.

Figure 4:
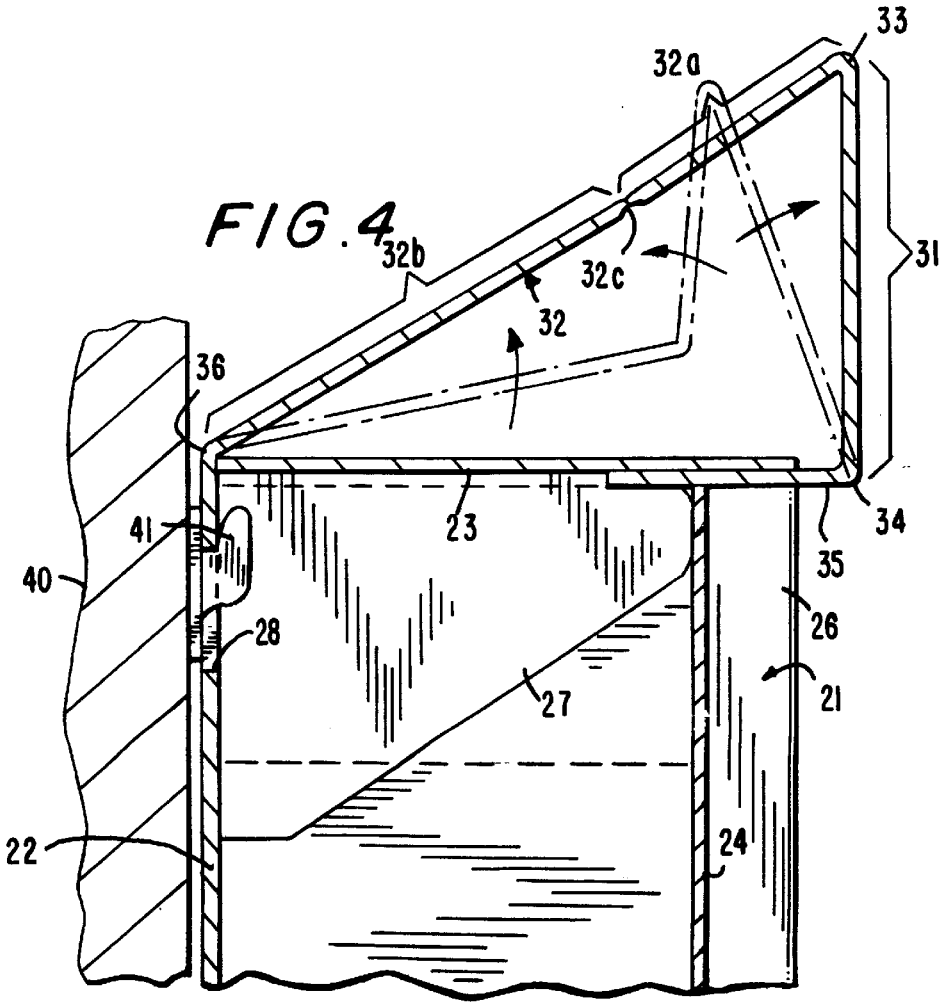
FIG. 4 is a partial sectional view taken on line 4—4 of FIG. 3, drawn to a scale akin to that of, and showing substantially the same portion of the display structure as, FIG. 2 but with the information-bearing formation in its deployed condition and orientation.

On the other hand, the material that had been compressed still retains most if not all of the resiliency it had in its uncompressed state so that, upon reduction in or cessation of such external forces, it will strive to regain its original compressed but unbent or unfolded state, taking the sections 32*a* and 32*b* with it from their fully folded positions through their positions shown in dash-dotted lines in FIG. 4 ultimately to their positions shown there in solid lines, as indicated by respective arrows. It goes without saying that this automatic unfolding action may be, and usually is, to a considerable degree supplemented or augmented by a similar action or propensity of the material of the fold region 33 and/or that of another fold region 34 situated between the front wall 31 and another wall 35, connecting these two walls 34 and 35 with each other.

The wall 35 serves as an anchor for the bottom portion of the front wall 31, keeping it in its desired position relative to the main body 21. To be able to perform this function, it is to be locked in place itself, that is, it has to constitute at least a part of a connecting means that connects the fold region 34 either directly or mediately with an end region 36 of the section 32*b* that is parallel to but remote from the hinge portion 32*c*. In the illustrated embodiment, this end region 36 is configured as yet another fold region that connects the section 32*b* with a back wall 22 of the main body 21 of the display device 20.

As indicated in FIG. 4, the anchor wall 35 may extend all the way to the fold region 36, but that need not necessarily be the case; rather, if so desired, it could stop just short of it, or even at a considerable distance from it, especially since it is not directly connected either to the auxiliary fold region 36 or to the back wall 22. Rather, the wall 35 is held in place relative to the fold region 36 and hence to the rest of the main portion 21 by cooperation with other portions of the main body 21, especially with wall panels 23 and 24. The wall panel 23 extends horizontally frontwardly from the back wall 22 forming a portion of the aforementioned top wall of the main portion 21, the other portion being constituted by the anchor wall 35.

However, the wall panel 23 is not directly connected with the back wall 22 either; instead, it is constituted by at least one flap connected to and forming an extension of one of two side walls 25 and 26 of the main portion 21, but preferably by two such flaps extending toward each other from the opposite side walls 25 and 26. Whether or not such flap 23 is also connected to the respective opposite side wall 26 or 25, or such flaps are also physically connected to such respective side walls 26 and 25 or to one another, they may already exert sufficient forces on the wall 35 to securely lodge or frictionally retain the wall 35 between itself or themselves and an upper edge region of the wall 24 that extends substantially vertically across an otherwise open front zone of the main portion 21 (once again, as considered in the depicted installed condition) and hence constitutes a false back wall of the display device 20 upon which the aforementioned promoted items may be mounted or otherwise supported when on display.

However, in the illustrated embodiment of the present invention, a still more secure retention of the anchor wall 35 in its ultimate position of use is accomplished by providing at least one partitioning or auxiliary support wall 27 in the interior of the main portion 21 of the display device 20, that is in the space delimited by the back wall 22 from the back and the false back wall 24 from the front. This auxiliary support wall 27 and the anchor wall 35 are provided with respective slots that open onto their respective edges facing one another and by means of which the support and anchor walls 27 and 35 can be interdigitated with one another. This interdigitation technique is so well known in the shipping industry, for instance for interconnecting orthogonal arrays of separating walls that keep wine bottles or similar fragile articles out of contact with one another as well as from conducting excessive movements within the shipping container, that it need not be illustrated in detail in the drawing; rather, it is merely indicated in broken lines. The frictional engagement between the surfaces bounding the aforementioned slots and those of the portions of the respective other walls 35 and 27 received in them then provides the desired measure of security for the retention of the anchor wall 35 in position even if that provided by the friction between the walls 23 and 35 is insufficient or even nonexistent.

As a comparison of FIGS. 2 and 4 will reveal, the back wall 22 of the main portion 21 of the display device 20 is provided with an aperture 28. While only one such aperture 28 is shown (and would be sufficient under some circumstances), ordinarily at least two such apertures 28 are formed in the back wall 22, spaced from one another in the transverse direction, that is substantially normal to the side walls 25 and 26. The reason for making such apertures 28 can be most clearly perceived from FIG. 4 of the drawing; namely, they serve for hanging the display device 20 on a backing structure 40, such as a store wall, a shelf-supporting structure or the like. As shown, a generally hook-shaped element 41 is secured in any known manner to the structure 40, and projects from it into and beyond the aperture 28 to engage behind (i.e., in front of, using the previously adopted convention) the back wall 22 upwardly of the aperture 28.

In the above description, references have been had to various directions, such as "up", "down", etc., as well as to relative positions, such as "top", "bottom" or the like. All these designations are to be understood as relating solely to the mounting position illustrated in FIGS. 3 and 4 of the drawing. On the other hand, if it were decided, as is also contemplated within the framework of the present invention, to employ the measures described above in display devices that are to be lying on the floor when in use, with their open area containing the items on display facing upwardly, then such expressions or modifiers are to be interpreted accordingly. Thus, for instance, "up" would refer to the portion farther away from the observer, and so on. Of course, the "vertical" plane referred to above, would become, in absolute terms (relative to the environment) horizontal, or substantially so (especially if the device 20 supported such that its "upper" portion would be at a somewhat higher elevation than its "bottom" portion); yet, relative to the device 20, it would still remain "vertical" because it would extend from "up" to "down" as those expressions have been interpreted or qualified here to cover that situation.

It will be understood that each of the elements described above, or two or more together, may also find a useful application in other types of constructions differing from the type described above. So, for instance, it is currently contemplated to employ the principles presented above in formations in all material respects resembling or identical to the formation 30 described above but separate from the support on which they are to be mounted, whether they are ultimately attached to such a support or merely resting on it. Even under these circumstances, namely, the advantages of the features mentioned above, that is, the foldability of the wall 32 coupled with the tendency of the various hinge or fold portions 32*c*, 33 and 34 to cause the formation 30 to unfold or become erected or deployed once released from the confining action of, for instance, a shipping carton, a rubber band, a tying strap, an adhesive tape, or the like, are still present. All these alternatives constitute equivalent holding means as set forth in the appended claims.

Moreover, the weakening of the hinge portion 32*c* can be achieved, instead or in addition to the aforementioned compression, by providing a line of perforations, such as slots, along most if not all of the hinge portion 32*c*, with the caveat, however, that the presence of such perforations must not unduly impair the aforementioned "memory" characteristic of the hinge portion 32*c*.

The information on the front panel 31 includes any alphanumeric, artwork, graphical, human-or machine-readable, indicia. Such indicia can be applied to the front panel 31 by any known technique, including printing, silk screening, offset lithography or the like.

While the present invention has been described and illustrated herein as embodied in a specific construction of an automatically deployable, information-bearing display panel incorporated or associated with a display structure, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A display arrangement for displaying information about items on display, comprising:

a) a display structure for supporting the items on display;

b) an information-bearing display panel mounted on said structure for movement between folded and deployed conditions in which the information is respectively concealed and visible;

c) a holder for releasably holding said display panel with a holding action in said folded condition; and d) means for automatically erecting said display panel to said deployed condition upon release of the holding action by said holder, said erecting means including a foldable bracing wall having a first section connected to said display panel, and a second section connected to said display structure, said sections being interconnected along, and foldable about, a hinge portion for movement between a juxtaposed position in which said sections engage each other in said folded condition, and a bracing position in which said sections are co-planar in said deployed condition.

2. The display arrangement as defined in claim 1, wherein the display structure includes a main body having walls bounding an opening that lies in a plane, and wherein said display panel lies in a display plane that is parallel to the plane of said opening.

3. The display arrangement as defined in claim 2, wherein one of said walls of said main body has an aperture.

4. The display arrangement as defined in claim 1, wherein said holder includes a shipping container that accommodates said display structure in its entirety and has a container wall that confines said display panel in said folded condition between said container wall and said display structure.

5. The display arrangement as defined in claim 1, wherein said display panel is of one-piece with, and is integrally hinged to, said display structure.

6. The display arrangement as defined in claim 1, wherein said hinge portion is constituted of a compressible material having a memory that constantly urges said sections to said bracing position.

7. The display arrangement as defined in claim 1, wherein said display structure has a generally planar top wall, and wherein said display panel overlies said top wall in said folded condition, and wherein said bracing wall positions said display panel at a right angle to said top wall in said deployed condition.

8. A display arrangement for displaying information about items being offered to the public, comprising:

a) a display structure for supporting the items, and including a generally box-shaped main body having a top portion, a bottom portion, and two side portions as considered in a position of use of the display structure, as well as a front region facing an observer of the display structure in said use position thereof and a back wall remote from said front region;

b) a formation secured to and extending along one of said portions of said main body and including i) a front wall situated at said front region, anchored to said one portion of said main body, and having a front surface carrying information to be brought to the attention of the observer, and ii) a bracing wall connected to said main body at said back wall, and hingedly connected to said front wall, said bracing wall including two sections and a hinge portion connecting said two sections to one another for folding into juxtaposition with one another in response to external forces tending to move said front wall and said sections of said bracing wall from said deployed condition to a collapsed condition of said formation; and c) means for holding said formation in said collapsed condition thereof with a holding action prior to the display structure assuming said use position.

9. The display device as defined in claim 8, wherein said holding means includes a shipping container that accommodates the display structure in its entirety and has a wall that confines said formation in said collapsed condition thereof between itself and said main body.

10. The display arrangement as defined in claim 8, wherein said hinge portion has resilient properties to urge said formation toward and into said deployed condition thereof once the holding action of said holding means is discontinued.

* * * * *